US010551117B2

(12) United States Patent
Pierre, Jr. et al.

(10) Patent No.: US 10,551,117 B2
(45) Date of Patent: Feb. 4, 2020

(54) METHOD OF NATURAL GAS LIQUEFACTION ON LNG CARRIERS STORING LIQUID NITROGEN

(71) Applicants: Fritz Pierre, Jr., Humble, TX (US); Donald J. Victory, Sugar Land, TX (US)

(72) Inventors: Fritz Pierre, Jr., Humble, TX (US); Donald J. Victory, Sugar Land, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 221 days.

(21) Appl. No.: 15/348,004

(22) Filed: Nov. 10, 2016

(65) Prior Publication Data

US 2017/0167787 A1 Jun. 15, 2017

Related U.S. Application Data

(60) Provisional application No. 62/266,983, filed on Dec. 14, 2015.

(51) Int. Cl.
*F25J 1/02* (2006.01)
*F25J 1/00* (2006.01)

(52) U.S. Cl.
CPC ..... *F25J 1/0277* (2013.01); *F25J 1/0015* (2013.01); *F25J 1/0022* (2013.01); *F25J 1/0042* (2013.01);
(Continued)

(58) Field of Classification Search
CPC ..... F25J 1/0022; F25J 1/0072; F25J 1/0015; F25J 1/904; F25J 1/90; F25J 1/0223;
(Continued)

(56) References Cited

U.S. PATENT DOCUMENTS 3,180,709 A 4/1965 Yendall et al. ..... 23/210
3,347,055 A 10/1967 Blanchard et al. ..... 62/9
(Continued)

FOREIGN PATENT DOCUMENTS

CN 102628635 10/2014 ..... F25J 3/08
DE 1960515 5/1971 ..... F25J 1/02
(Continued)

OTHER PUBLICATIONS

U.S. Appl. No. 15/347,968, filed Nov. 10, 2016, Pierre, Fritz Jr. et al.
(Continued)

*Primary Examiner* — Brian M King
(74) *Attorney, Agent, or Firm* — ExxonMobil Upstream Research Company—Law Department

(57) ABSTRACT

A method for producing liquefied natural gas (LNG). A natural gas stream is transported to a liquefaction vessel. The natural gas stream is liquefied on the liquefaction vessel using at least one heat exchanger that exchanges heat between the natural gas stream and a liquid nitrogen stream to at least partially vaporize the liquefied nitrogen stream, thereby forming a warmed nitrogen gas stream and an at least partially condensed natural gas stream comprising LNG. The liquefaction vessel includes at least one tank that only stores liquid nitrogen and at least one tank that only stores LNG.

29 Claims, 9 Drawing Sheets

(52) U.S. Cl.
CPC ..... *F25J 1/0072* (2013.01); *F25J 1/0204* (2013.01); *F25J 1/0221* (2013.01); *F25J 1/0223* (2013.01); *F25J 1/0265* (2013.01); *F25J 1/0278* (2013.01); *F25J 2210/42* (2013.01); *F25J 2210/60* (2013.01); *F25J 2210/62* (2013.01); *F25J 2230/20* (2013.01); *F25J 2235/42* (2013.01); *F25J 2240/02* (2013.01); *F25J 2240/12* (2013.01); *F25J 2270/16* (2013.01); *F25J 2290/60* (2013.01); *F25J 2290/72* (2013.01)

(58) Field of Classification Search
CPC .. F25J 1/0221; F25J 2270/14; F25J 2270/904; F25J 2270/90; F25J 2265/034
See application file for complete search history.

(56) References Cited

U.S. PATENT DOCUMENTS

| | | | | |
|---|---|---|---|---|
| 3,370,435 | A | 2/1968 | Arregger | 62/28 |
| 3,400,547 | A * | 9/1968 | Williams | B63B 25/08 62/50.1 |
| 3,724,226 | A | 4/1973 | Pachaly | 62/39 |
| 3,878,689 | A | 4/1975 | Grenci | 62/9 |
| 4,415,345 | A | 11/1983 | Swallow | 62/28 |
| 5,025,860 | A | 6/1991 | Mandrin | 166/267 |
| 5,137,558 | A | 8/1992 | Agrawal | 62/24 |
| 5,139,547 | A | 8/1992 | Agrawal et al. | 62/8 |
| 5,141,543 | A | 8/1992 | Agrawal et al. | 62/8 |
| 5,390,499 | A * | 2/1995 | Rhoades | F25J 1/0221 62/614 |
| 5,638,698 | A | 6/1997 | Knight et al. | 62/632 |
| 5,950,453 | A | 9/1999 | Bowen et al. | 62/612 |
| 6,003,603 | A | 12/1999 | Breivik et al. | 166/357 |
| 6,295,838 | B1 | 10/2001 | Shah et al. | 62/643 |
| 6,298,688 | B1 | 10/2001 | Brostow et al. | 62/613 |
| 6,412,302 | B1 | 7/2002 | Foglietta | 62/611 |
| 6,662,589 | B1 | 12/2003 | Roberts et al. | 62/425 |
| 6,917,383 | B2 | 7/2005 | Hamasaki et al. | |
| 7,143,606 | B2 | 12/2006 | Trainer | 62/611 |
| 7,278,281 | B2 | 10/2007 | Yang et al. | 62/612 |
| 7,386,996 | B2 | 6/2008 | Fredheim et al. | 62/612 |
| 7,520,143 | B2 | 4/2009 | Spilsbury | 62/620 |
| 7,712,331 | B2 | 5/2010 | Dee et al. | 62/612 |
| 8,079,321 | B2 | 12/2011 | Balasubramanian | 114/74 |
| 8,375,875 | B2 | 2/2013 | Kim et al. | |
| 8,435,403 | B2 | 5/2013 | Sapper et al. | 208/254 |
| 8,464,289 | B2 | 6/2013 | Pan | 725/34 |
| 8,601,833 | B2 | 12/2013 | Dee et al. | 62/648 |
| 8,616,012 | B2 | 12/2013 | Duerr et al. | 62/89 |
| 8,646,289 | B1 * | 2/2014 | Shivers, III | F25J 1/0052 114/230.14 |
| 9,016,088 | B2 | 4/2015 | Butts | 62/613 |
| 9,422,037 | B2 | 8/2016 | VanWijngaarden et al. | 114/74 |
| 9,435,229 | B2 | 9/2016 | Alekseev | 60/643 |
| 9,459,042 | B2 | 10/2016 | Chantant | 62/50.2 |
| 2003/0226373 | A1 | 12/2003 | Prible et al. | 62/612 |
| 2006/0000615 | A1 | 1/2006 | Choi | 166/352 |
| 2009/0217701 | A1 | 9/2009 | Minta et al. | 62/612 |
| 2010/0192626 | A1 | 8/2010 | Chantant | 62/606 |
| 2010/0251763 | A1 | 10/2010 | Audun | 62/614 |
| 2011/0036121 | A1 | 2/2011 | Roberts et al. | 62/612 |
| 2011/0126451 | A1 | 6/2011 | Pan et al. | 44/451 |
| 2011/0259044 | A1 | 10/2011 | Baudat et al. | 62/611 |
| 2012/0285196 | A1 | 11/2012 | Fiinn et al. | 62/620 |
| 2013/0199238 | A1 | 8/2013 | Mock et al. | 62/611 |
| 2014/0130542 | A1 | 5/2014 | Brown et al. | 62/612 |
| 2015/0285553 | A1 | 10/2015 | Oelfke et al. | 62/611 |
| 2017/0010041 | A1 | 1/2017 | Pierre, Jr. et al. | 62/616 |
| 2017/0016667 | A1 | 1/2017 | Huntington et al. | 62/614 |

FOREIGN PATENT DOCUMENTS

| | | | |
|---|---|---|---|
| DE | 2354726 | 5/1975 | F17C 9/04 |
| DE | 102013007208 | 10/2014 | B01D 3/14 |
| EP | 1972875 | 9/2008 | F25J 3/04 |
| FR | 2756368 | 5/1998 | B01D 53/26 |
| GB | 1376678 | 12/1974 | F25J 1/02 |
| GB | 1596330 | 8/1981 | F25J 1/02 |
| GB | 2172388 | 9/1986 | E21B 43/16 |
| GB | 2333148 | 7/1999 | F25J 1/02 |
| GB | 2470062 | 11/2010 | F25J 1/02 |
| GB | 2486036 | 11/2012 | F25J 1/02 |
| JP | S59216785 | 12/1984 | F17C 13/00 |
| JP | H05-203342 | 1/1991 | |
| JP | 2003-146400 | 5/2002 | |
| WO | WO2006/120127 | 11/2006 | F25J 3/02 |
| WO | WO2007/011155 | 1/2007 | |
| WO | WO2015/110443 | 7/2015 | F25J 1/00 |

OTHER PUBLICATIONS

U.S. Appl. No. 15/347,983, filed Nov. 10, 2016, Pierre, Fritz Jr. et al.
U.S. Appl. No. 15/348,533, filed Nov. 10, 2016, Pierre, Fritz Jr.
U.S. Appl. No. 62/458,127, filed Feb. 13, 2017, Pierre, Fritz Jr.
U.S. Appl. No. 62/458,131, filed Feb. 13, 2017, Pierre, Fritz Jr.
U.S. Appl. No. 62/463,274, filed Feb. 24, 2017, Kaminsky, Robert D. et al.
U.S. Appl. No. 62/478,961, Balasubramanian, Sathish.
Publication No. 43031 (2000) Research Disclosure, Mason Publications, Hampshire, GB, Feb. 1, 2000, p. 239, XP000969014, ISSN: 0374-4353, paragraphs [0004], [0005] & [0006].
Publication No. 37752 (1995) Research Disclosure, Mason Publications, Hampshire, GB, Sep. 1, 1995, p. 632, XP000536225, ISSN: 0374-4353, 1 page.
Bach, Wilfried (1990) "Offshore Natural Gas Liquefaction with Nitrogen Cooling—Process Design and Comparison of Coil-Wound and Plate-Fin Heat Exchangers," *Science and Technology Reports*, No. 64, Jan. 1, 1990, pp. 31-37.
U.S. Appl. No. 15/182,050, filed Jun. 14, 2016, Pierre Jr., Fritz et al.

* cited by examiner

METHOD OF NATURAL GAS LIQUEFACTION ON LNG CARRIERS STORING LIQUID NITROGEN

CROSS REFERENCE TO RELATED APPLICATIONS

This application claims the benefit of U.S. Provisional Patent Application 62/266,983, filed Dec. 14, 2015 entitled METHOD OF NATURAL GAS LIQUEFACTION ON LNG CARRIERS STORING LIQUID NITROGEN, the entirety of which is incorporated by reference herein.

This application is related to U.S. Provisional Patent Application No. 62/266,976 titled "Method and System for Separating Nitrogen from Liquefied Natural Gas Using Liquefied Nitrogen;" U.S. Provisional Patent Application No. 62/266,979 titled "Expander-Based LNG Production Processes Enhanced With Liquid Nitrogen;" and U.S. Provisional Patent Application No. 62/622,985 titled "Pre-Cooling of Natural Gas by High Pressure Compression and Expansion," all having common inventors and assignee and filed on an even date herewith, the disclosure of which is incorporated by reference herein in their entirety.

BACKGROUND

Field of Disclosure

The disclosure relates generally to the field of natural gas liquefaction to form liquefied natural gas (LNG). More specifically, the disclosure relates to the production and transfer of LNG from offshore and/or remote sources of natural gas.

Description of Related Art

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as an admission of prior art.

LNG is a rapidly growing means to supply natural gas from locations with an abundant supply of natural gas to distant locations with a strong demand for natural gas. The conventional LNG cycle includes: a) initial treatments of the natural gas resource to remove contaminants such as water, sulfur compounds and carbon dioxide; b) the separation of some heavier hydrocarbon gases, such as propane, butane, pentane, etc. by a variety of possible methods including self-refrigeration, external refrigeration, lean oil, etc.; c) refrigeration of the natural gas substantially by external refrigeration to form liquefied natural gas at or near atmospheric pressure and about −160° C.; d) transport of the LNG product in ships or tankers designed for this purpose to a market location; and e) re-pressurization and regasification of the LNG at a regasification plant to a pressurized natural gas that may distributed to natural gas consumers. Step (c) of the conventional LNG cycle usually requires the use of large refrigeration compressors often powered by large gas turbine drivers that emit substantial carbon and other emissions. Large capital investments in the billions of US dollars and extensive infrastructure are required as part of the liquefaction plant. Step (e) of the conventional LNG cycle generally includes re-pressurizing the LNG to the required pressure using cryogenic pumps and then re-gasifying the LNG to pressurized natural gas by exchanging heat through an intermediate fluid but ultimately with seawater or by combusting a portion of the natural gas to heat and vaporize the LNG. Generally, the available exergy of the cryogenic LNG is not utilized.

A relatively new technology for producing LNG is known as floating LNG (FLNG). FLNG technology involves the construction of the gas treating and liquefaction facility on a floating structure such as barge or a ship. FLNG is a technology solution for monetizing offshore stranded gas where it is not economically viable to construct a gas pipeline to shore. FLNG is also increasingly being considered for onshore and near-shore gas fields located in remote, environmentally sensitive and/or politically challenging regions. The technology has certain advantages over conventional onshore LNG in that it has a lower environmental footprint at the production site. The technology may also deliver projects faster and at a lower cost since the bulk of the LNG facility is constructed in shipyards with lower labor rates and reduced execution risk.

Although FLNG has several advantages over conventional onshore LNG, significant technical challenges remain in the application of the technology. For example, the FLNG structure must provide the same level of gas treating and liquefaction in an area that is often less than a quarter of what would be available for an onshore LNG plant. For this reason, there is a need to develop technology that reduces the footprint of the FLNG plant while maintaining the capacity of the liquefaction facility to reduce overall project cost. One promising means of reducing the footprint is to modify the liquefaction technology used in the FLNG plant. Known liquefaction technologies include a single mixed refrigerant (SMR) process, a dual mixed refrigerant (DMR) process, and expander-based (or expansion) process. The expander-based process has several advantages that make it well suited for FLNG projects. The most significant advantage is that the technology offers liquefaction without the need for external hydrocarbon refrigerants. Removing liquid hydrocarbon refrigerant inventory, such as propane storage, significantly reduces safety concerns that are particularly acute on FLNG projects. An additional advantage of the expander-based process compared to a mixed refrigerant process is that the expander-based process is less sensitive to offshore motions since the main refrigerant mostly remains in the gas phase.

Although expander-based process has its advantages, the application of this technology to an FLNG project with LNG production of greater than 2 million tons per year (MTA) has proven to be less appealing than the use of the mixed refrigerant process. The capacity of known expander-based process trains is typically less than 1.5 MTA. In contrast, a mixed refrigerant process train, such as that of the propane-precooled process or the dual mixed refrigerant process, can have a train capacity of greater than 5 MTA. The size of the expander-based process train is limited since its refrigerant mostly remains in the vapor state throughout the entire process and the refrigerant absorbs energy through its sensible heat. For these reasons, the refrigerant volumetric flow rate is large throughout the process, and the size of the heat exchangers and piping are proportionately greater than those used in a mixed refrigerant process. Furthermore, the limitations in compander horsepower size results in parallel rotating machinery as the capacity of the expander-based process train increases. The production rate of an FLNG project using an expander-based process can be made to be greater than 2 MTA if multiple expander-based trains are allowed. For example, for a 6 MTA FLNG project, six or more parallel expander-based process trains may be sufficient to achieve the required production. However, the equipment count, complexity and cost all increase with multiple expander trains. Additionally, the assumed process simplicity of the expander-based process compared to a mixed refrigerant process begins to be questioned if multiple trains are required for the expander-based process while the mixed refrigerant process can obtain the required production rate with one or two trains. For these reasons, there is a need to develop an FLNG liquefaction process with the advantages of an expander-based process while achieving a high LNG production capacity. There is a further need to develop an FLNG technology solution that is better able to handle the challenges that vessel motion has on gas processing and LNG loading and offloading.

Once LNG is produced, it must be moved to market, typically in LNG ships. For onshore LNG facilities, the transfer of LNG to ships is done in sheltered water such as in a harbor or from berths in more mild environmental conditions. Often FLNG requires LNG to be transferred in more open water. In open water, the design solutions for LNG transfer to merchant LNG ships becomes more limited and expensive. In addition, the marine operations of tankers versus the FLNG facilities can become more complicated such as open-water berthing of a tanker either in tandem or side-by-side. Design options become more limited and often more expensive as the designed-for ocean conditions become more severe. For these reasons, there is a further need to develop an FLNG technology solution that is better able to handle the transfer of LNG in more challenging ocean or metocean conditions.

U.S. Pat. No. 5,025,860 to Mandrin discloses an FLNG technology where natural gas is produced and treated using a floating production unit (FPU). The treated natural gas is compressed on the FPU to form a high pressure natural gas. The high pressure natural gas is transported to a liquefaction vessel via a high-pressure pipeline where the gas may be cooled or additionally cooled via indirect heat exchange with the sea water. The high pressure natural gas is cooled and partially condensed to LNG by expansion of the natural gas on the liquefaction vessel. The LNG is stored in tanks within the liquefaction vessel. Uncondensed natural gas is returned to the FPU via a return low pressure gas pipeline. The disclosure of Mandrin has an advantage of a minimal amount of process equipment on the liquefaction vessel since there are no gas turbines, compressors or other refrigerant systems on the liquefaction vessel. Mandrin, however, has significant disadvantages that limit its application. For example, since the liquefaction of the natural gas relies significantly on auto-refrigeration, the liquefaction process on the vessel has a poor thermodynamic efficiency when compared to known liquefaction processes that make use of one or more refrigerant streams. Additionally, the need for a return gas pipeline significantly increases the complexity of fluid transfer between the floating structures. The connection and disconnection of the two or more fluid pipelines between the FPU and the liquefaction vessel would be difficult if not impossible in open waters subject to waves and other severe metocean conditions.

United States Patent Application Publication No. 2003/0226373 to Prible, et al. discloses an FLNG technology where natural gas is produced and treated on an FPU. The treated natural gas is transported to a liquefaction vessel via a pipeline. The treated natural gas is cooled and condensed into LNG on the liquefaction vessel by indirect heat exchange with at least one gas phase refrigerant of an expander-based liquefaction process. The expanders, booster compressors and heat exchangers of the expander-based liquefaction process are mounted topside of the liquefaction vessel while the recycle compressors of the expander-based liquefaction process are mounted on the FPU. The at least one gas phase refrigerant of the expander-based process is transferred between floaters via gas pipelines. While the disclosure of Prible et al. has an advantage of using a liquefaction process that is significantly more efficient than the disclosure of Mandrin, using multiple gas pipeline connections between the floaters limits the application of this technology in challenging metocean conditions.

U.S. Pat. No. 8,646,289 to Shivers et al. discloses an FLNG technology where natural gas is produced and treated using an FPU, which is shown generally in FIG. 1 by reference number 100. The FPU 100 contains gas processing equipment to remove water, heavy hydrocarbons, and sour gases to make the produced natural gas suitable for liquefaction. The FPU also contains a carbon dioxide refrigeration unit to pre-cool the treated natural gas prior to being transported to the liquefaction vessel. The pre-cooled treated natural gas is transported to a liquefaction vessel 102 via a moored floating disconnectable turret 104 which can be connected and reconnected to the liquefaction vessel 102. The treated natural gas is liquefied onboard the liquefaction vessel 102 using a liquefaction unit 110 powered by a power plant 108, which may be a dual fuel diesel electric main power plant. The liquefaction unit 110 of the liquefaction vessel 102 contains dual nitrogen expansion process equipment to liquefy the treated and pre-cooled natural gas from the FPU 100. The dual nitrogen expansion process comprises a warm nitrogen loop and a cold nitrogen loop that are expanded to the same or near the same low pressure. The compressors of the dual nitrogen expansion process are driven by motors that are powered by the power plant 108, which may also provide the power for the propulsion of the liquefaction vessel 102. When the liquefaction vessel 102 has processed enough treated natural gas to be sufficiently loaded with LNG, the floating turret 104 is disconnected from the liquefaction vessel and the liquefaction vessel may move to a transfer terminal (not shown) located in benign metocean conditions, where the LNG is offloaded from the liquefaction vessel and loaded onto a merchant LNG ship. Alternatively, a fully loaded liquefaction vessel 102 may carry LNG directly to an import terminal (not shown) where the LNG is offloaded and regasified.

The FLNG technology solution described in U.S. Pat. No. 8,646,289 has several advantages over conventional FLNG technology where one floating structure is used for production, gas treating, liquefaction and LNG storage. The disclosed technology has the primary advantage of providing reliable operation in severe metocean conditions because transfer of LNG from the FPU to the transport vessel is not required. Furthermore, in contrast to the previously described FPU with liquefaction vessel technologies, this technology requires only one gas pipeline between the FPU and the liquefaction vessel. The technology has the additional advantage of reducing the required size of the FPU and reducing the manpower needed to be continuously present on the FPU since the bulk of the liquefaction process does not occur on its topside. The technology has the additional advantage allowing for greater production capacity of LNG even with the use of an expander-based liquefaction process since multiple liquefaction vessels may be connected to a single FPU by using multiple moored floating disconnectable turrets.

The FLNG technology solution described in U.S. Pat. No. 8,646,289 also has several challenges and limitations that may limit its application. For example, the liquefaction vessel is likely to be much more costly than a conventional LNG carrier because of the significant increase in onboard power demand and the change in the propulsion system. Each liquefaction vessel must be outfitted with a power plant sufficient to liquefy the natural gas. Approximately 80 to 100 MW of compression power is needed to liquefy 2 MTA of LNG. The technology proposes to limit the amount of installed power on the liquefaction vessel by using a dual fuel diesel electric power plant to provide propulsion power and liquefaction power. This option, however, is only expected to marginally reduce cost since electric propulsion for LNG carriers is not widely used in the industry. Furthermore, the required amount of installed power is still three to four more times greater than what would be required for propulsion of a conventional LNG carrier. It would be advantageous to have a liquefaction vessel where the required liquefaction power approximately matches or is lower than the required propulsion power. It would be much more advantageous to have a liquefaction vessel where the liquefaction process did not result in a need for a different propulsion system than what is predominantly used in conventional LNG carriers.

Another limitation of the FLNG technology solution described in U.S. Pat. No. 8,646,289 is that the dual nitrogen expansion process limits the production capacity of each liquefaction vessel to approximately 2 MTA or less. Although overall production can be increased by operating multiple liquefaction vessels 102, 102*a*, 102*b* simultaneously (FIG. 1), this option increases the number of ships and turrets needed for the operation. It would be much more preferable to outfit each liquefaction vessel with a liquefaction process capable of higher LNG production capacity while maintaining the compactness and safety benefits of the expander based process. A liquefaction vessel with an LNG storage capacity of 140,000 cubic meters ($m^3$) can support a daily LNG stream resulting in an annual production of approximately 6 MTA at a liquefaction vessel arrival frequency of 4 days.

Still another limitation of the FLNG technology solution described in U.S. Pat. No. 8,646,289 is that the technology has the disadvantage of requiring frequent startup, shutdown and turndown of the liquefaction system of the liquefaction vessel. The dual nitrogen expansion process has better startup and shutdown characteristics than a mixed refrigerant liquefaction process. However, the required frequency of startup and shutdown is still significantly greater than previous experience with the dual nitrogen expansion technology at the production capacities of interest. Thermal cycling of process equipment as well as other issues associated with frequent startups and shutdowns are considered new and significant risks to the application of this technology. It would be advantageous to have a liquefaction process that can be easily and rapidly ramped up to full capacity. It would also be advantageous to limit thermal cycling by maintaining the cold temperatures of the liquefaction process equipment with very little power use during periods of no LNG production.

Yet another limitation of the FLNG technology solution described in U.S. Pat. No. 8,646,289 is that the required power plant and liquefaction trains for this technology are expected to significantly increase the capital and operational cost of the liquefaction vessel over the typical cost of a conventional LNG carrier. As stated above, the power plant required for liquefaction will need to be three to four times greater than what is needed for ship propulsion. The liquefaction trains on the liquefaction vessel are similar to what is on a conventional FLNG structure. For this reason, outfitting each liquefaction vessel with its own liquefaction trains represents a significant increase in capital investment of liquefaction equipment compared to conventional FLNG structures. This technology limits the impact of the high cost of the liquefaction vessel, by proposing an LNG value chain where the loaded LNG liquefaction vessel moves to an intermediate transfer terminal where it offloads the LNG on to conventional LNG carriers. This transport scheme shortens the haul distance of the liquefaction vessel and thus reduces the required number of these vessels. However, it would much more preferable to have liquefaction vessels of sufficiently low cost that it would be economical to haul the LNG to market without having to transfer its cargo to less expensive ships.

SUMMARY

The present disclosure provides a method for producing liquefied natural gas (LNG). A natural gas stream is transported to a liquefaction vessel. The natural gas stream is liquefied on the liquefaction vessel using at least one heat exchanger that exchanges heat between the natural gas stream and a liquid nitrogen stream to at least partially vaporize the liquefied nitrogen stream, thereby forming a warmed nitrogen gas stream and an at least partially condensed natural gas stream comprising LNG. The liquefaction vessel includes at least one tank that only stores liquid nitrogen and at least one tank that only stores LNG.

The present disclosure also provides a system for liquefying a natural gas stream. A liquefaction vessel transports liquefied natural gas from a first location to a second location and transports liquefied nitrogen (LIN) to the first location. The liquefaction vessel includes at least one tank that only stores LIN and at least one tank that only stores LNG. The liquefaction vessel also includes an LNG liquefaction system including at least one heat exchanger that exchanges heat between a LIN stream from LIN stored on the natural gas liquefaction vessel and the natural gas stream, which is transported to the natural gas liquefaction vessel, to at least partially vaporize the LIN stream, thereby forming a warmed nitrogen gas stream and an at least partially condensed natural gas stream comprising LNG. The LNG is stored on the natural gas liquefaction vessel to be transported to the second location.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
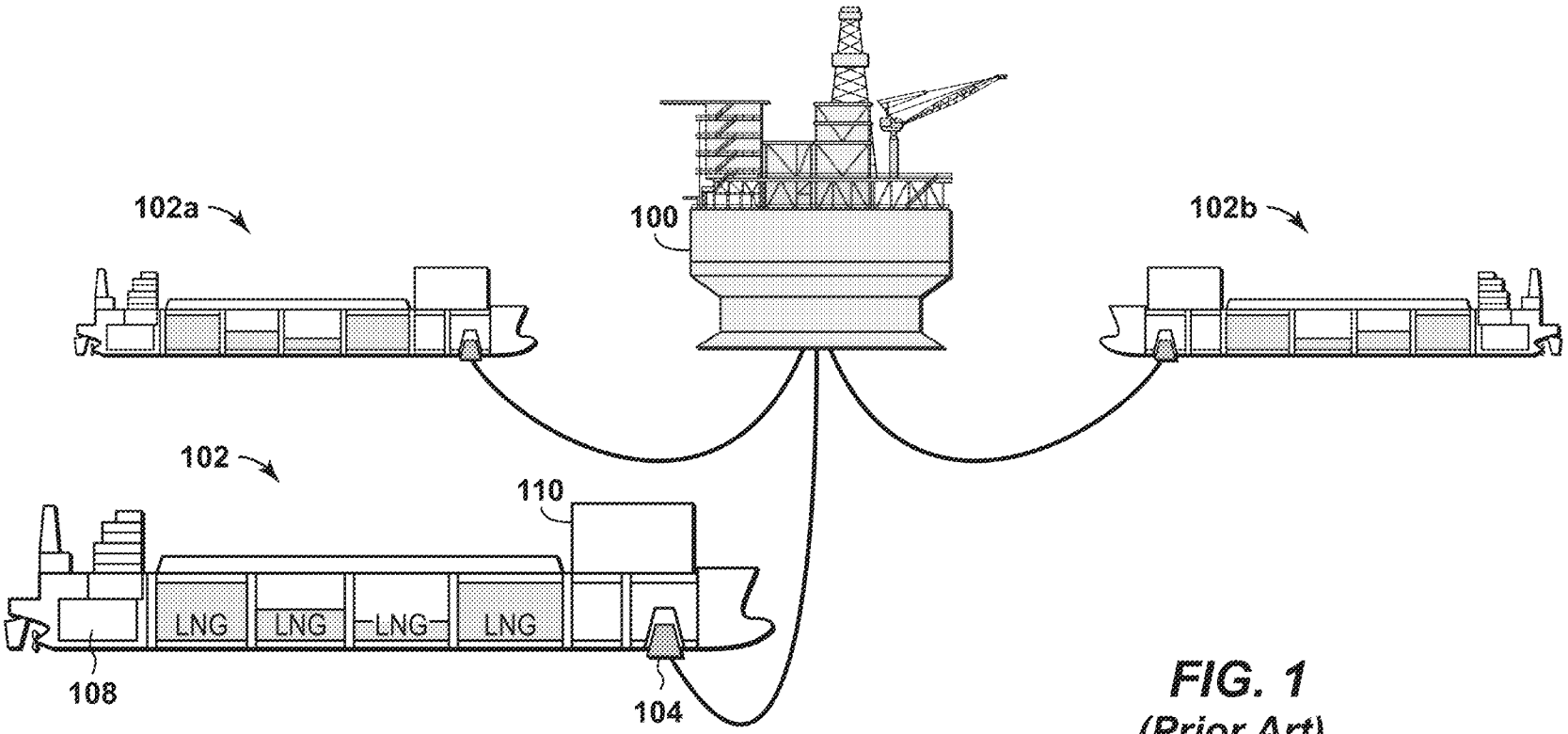
FIG. 1 (Prior Art)
FIG. 1 is a simplified diagram of LNG production according to known principles.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

To promote an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. For the sake clarity, some features not relevant to the present disclosure may not be shown in the drawings.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

The articles "the," "a" and "an" are not necessarily limited to mean only one, but rather are inclusive and open ended so as to include, optionally, multiple such elements.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

The term "heat exchanger" refers to a device designed to efficiently transfer or "exchange" heat from one matter to another. Exemplary heat exchanger types include a co-current or counter-current heat exchanger, an indirect heat exchanger (e.g. spiral wound heat exchanger, plate-fin heat exchanger such as a brazed aluminum plate fin type, shell-and-tube heat exchanger, etc.), direct contact heat exchanger, or some combination of these, and so on.

The term "dual purpose carrier" refers to a ship capable of (a) transporting LIN to an export terminal for natural gas and/or LNG and (b) transporting LNG to an LNG import terminal.

As previously described, the conventional LNG cycle includes: (a) initial treatments of the natural gas resource to remove contaminants such as water, sulfur compounds and carbon dioxide; (b) the separation of some heavier hydrocarbon gases, such as propane, butane, pentane, etc. by a variety of possible methods including self-refrigeration, external refrigeration, lean oil, etc.; (c) refrigeration of the natural gas substantially by external refrigeration to form liquefied natural gas at or near atmospheric pressure and about −160° C.; (d) transport of the LNG product in ships or tankers designed for this purpose to a market location; and (e) re-pressurization and regasification of the LNG at a regasification plant to a pressurized natural gas that may distributed to natural gas consumers. The present disclosure modifies steps (c) and (e) of the conventional LNG cycle by liquefying natural gas on a liquefied natural gas (LNG) transport vessel using liquid nitrogen (LIN) as the coolant, and using the exergy of the cryogenic LNG to facilitate the liquefaction of nitrogen gas to form LIN that may then be transported to the resource location and used as a source of refrigeration for the production of LNG. The disclosed LIN-to-LNG concept may further include the transport of LNG in a ship or tanker from the resource location (export terminal) to the market location (import terminal) and the reverse transport of LIN from the market location to the resource location.

The disclosure more specifically describes a method for liquefying natural gas on a liquefaction vessel having multiple storage tanks associated therewith, where at least one tank exclusively stores liquid nitrogen used in the liquefaction process, and at least one tank stores LNG exclusively. Treated natural gas suitable for liquefaction may be transported to the liquefaction vessel via a moored floating disconnectable turret which can be connected and reconnected to the liquefaction vessel. The treated natural gas may be liquefied on the liquefaction vessel using at least one heat exchanger that exchanges heat between a liquid nitrogen stream and the natural gas stream to at least partially vaporize the liquefied nitrogen stream and at least partially condense the natural gas stream. The LNG stream may be stored in the liquefaction vessel either in the at least one tank reserved for LNG storage or in other tanks onboard the liquefaction vessel configured to store either LNG or LIN.

In an aspect of the disclosure, natural gas may be produced and treated using a floating production unit (FPU). The treated natural gas may be transported from the FPU to a liquefaction vessel via one or more moored floating disconnectable turrets which can be connected and reconnected to one or more liquefaction vessels. The liquefaction vessel may include at least one tank that only stores LIN. The treated natural gas may be liquefied on the liquefaction vessel using at least one heat exchanger that exchanges heat between a liquid nitrogen stream and the natural gas stream to at least partially vaporize the liquefied nitrogen stream and at least partially condense the natural gas stream. The liquefied natural gas stream may be stored in at least one tank that only stores LNG within the liquefaction vessel. The FPU may contain gas processing equipment to remove impurities, if present, such as water, heavy hydrocarbons, and sour gases to make the produced natural gas suitable for liquefaction and or marketing. The FPU may also contain means to pre-cool the treated natural gas prior to being transported to the liquefaction vessel, such as deep sea-water retrieval and cooling and/or mechanical refrigeration. Since the LNG is produced on the transporting tanker, over-water transfer of LNG at the production site is eliminated.

In another aspect, natural gas processing facilities located at an onshore production site may be used to remove any impurities present in natural gas, such as water, heavy hydrocarbons, and sour gases, to make the produced natural gas suitable for liquefaction and or marketing. The treated natural gas may be transported offshore using a pipeline and one or more moored floating disconnectable turrets which can be connected and reconnected to one or more liquefaction vessels. The treated natural gas may be transferred to one or more liquefaction vessels that includes at least one tank that only stores LIN and at least one tank that only stores LNG. The treated natural gas may be liquefied on the liquefaction vessel using at least one heat exchanger that exchanges heat between a LIN stream and the treated natural gas stream to at least partially vaporize the LIN stream and at least partially condense the natural gas stream. The LNG stream produced thereby may be stored either in the at least one tank that only stores LNG, or in another tank onboard the liquefaction vessel that is configured to store either LNG or LIN. Since the LNG is produced on the liquefaction vessel, which also serves as a transportation vessel, over-water transfer of LNG at the production site is eliminated.

In yet another aspect of the disclosure, onshore natural gas processing facilities may remove impurities, if present, such as water, heavy hydrocarbons, and sour gases, to make the produced natural gas suitable for liquefaction and/or marketing. The treated natural gas may be transported near-shore via a pipeline and gas loading arms connected to one or more berthed liquefaction vessels. Conventional LNG carriers, LIN carriers and/or dual-purpose carriers may be berthed alongside, proximal, or nearby the liquefaction vessels to receive LNG from the liquefaction vessel and/or transport liquid nitrogen to the liquefaction vessel. The liquefaction vessels may be connected to cryogenic loading arms to allow for cryogenic fluid transfer between liquefaction vessels and/or the LNG/LIN/dual-purpose carriers. The liquefaction vessel may include at least one tank that only stores liquid nitrogen and at least one tank that only stores LNG. The treated natural gas may be liquefied on the liquefaction vessel using at least one heat exchanger that exchanges heat between a LIN stream and the natural gas stream to at least partially vaporize the liquefied nitrogen stream and at least partially condense the natural gas stream. The LNG gas stream produced thereby may be stored in the at least one tank that only stores LNG and/or in at least one tank onboard the liquefaction vessel configured to store either LIN or LNG. In a further aspect, one permanently docked liquefaction vessel may liquefy the treated natural gas from onshore. The produced LNG may be transported from the liquefaction vessel to one or more dual-purpose carriers. LIN may be transported from the one or more dual-purpose carriers to the liquefaction vessel.

Figure 2:
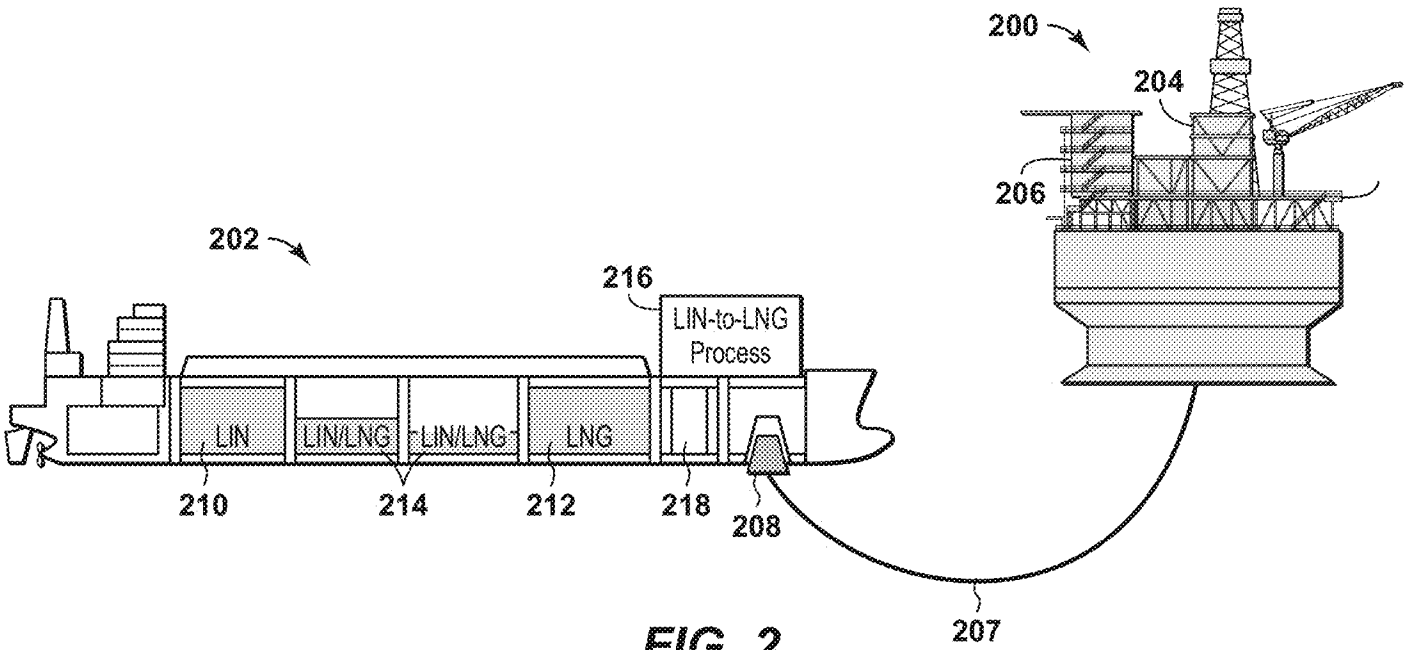
FIG. 2 is a simplified diagram of LNG production according to disclosed aspects.

FIG. 2 depicts a floating production unit (FPU) 200 and liquefaction vessel 202 according to a disclosed aspect. Natural gas may be produced and treated on the FPU 200. The FPU 200 may contain gas processing equipment 204 to remove impurities, if present, from the natural gas, to make the produced natural gas suitable for liquefaction and/or marketing. Such impurities may include water, heavy hydrocarbons, sour gases, and the like. The FPU may also contain one or more pre-cooling means 206 to pre-cool the treated natural gas prior to being transported to the liquefaction vessel. The pre-cooling means 206 may comprise deep sea-water retrieval and cooling, mechanical refrigeration, or other known technologies. The pre-cooled treated natural gas may be transported from the FPU 200 to a liquefaction vessel via a pipeline 207 and one or more moored floating disconnectable turrets 208 which can be connected and reconnected to one or more liquefaction vessels. The liquefaction vessel 202 may include a LIN tank 210 that only stores liquid nitrogen and an LNG tank 212 that only stores LNG. The liquefaction vessel 202 may also include a multi-purpose tank 214 that may store either LIN or LNG. The pre-cooled treated natural gas may be liquefied on the liquefaction vessel using equipment in a LIN-to-LNG process module 216, which may include at least one heat exchanger that exchanges heat between a LIN stream (from the LIN stored on the liquefaction vessel) and the pre-cooled treated natural gas stream, to at least partially vaporize the LIN stream and at least partially condense the pre-cooled treated natural gas stream to form LNG. The liquefaction vessel 202 may also comprise additional utility systems 218 associated with the liquefaction process. The utility systems 218 may be located within the hull of the liquefaction vessel 202 and/or on the topside of the vessel. The LNG produced by the LIN-to-LNG process module 216 may be stored either in the LNG tank 212 or in the multi-purpose tank 214. Since the LNG is produced on the liquefaction vessel, which also serves as a transportation vessel, over-water transfer of LNG at the production site is eliminated. It is anticipated that LIN tank 210, LNG tank 212, and multi-purpose tank 214 may comprise multiple LIN tanks, multiple LNG tanks, and multiple multi-purpose tanks, respectively.

Figure 3:
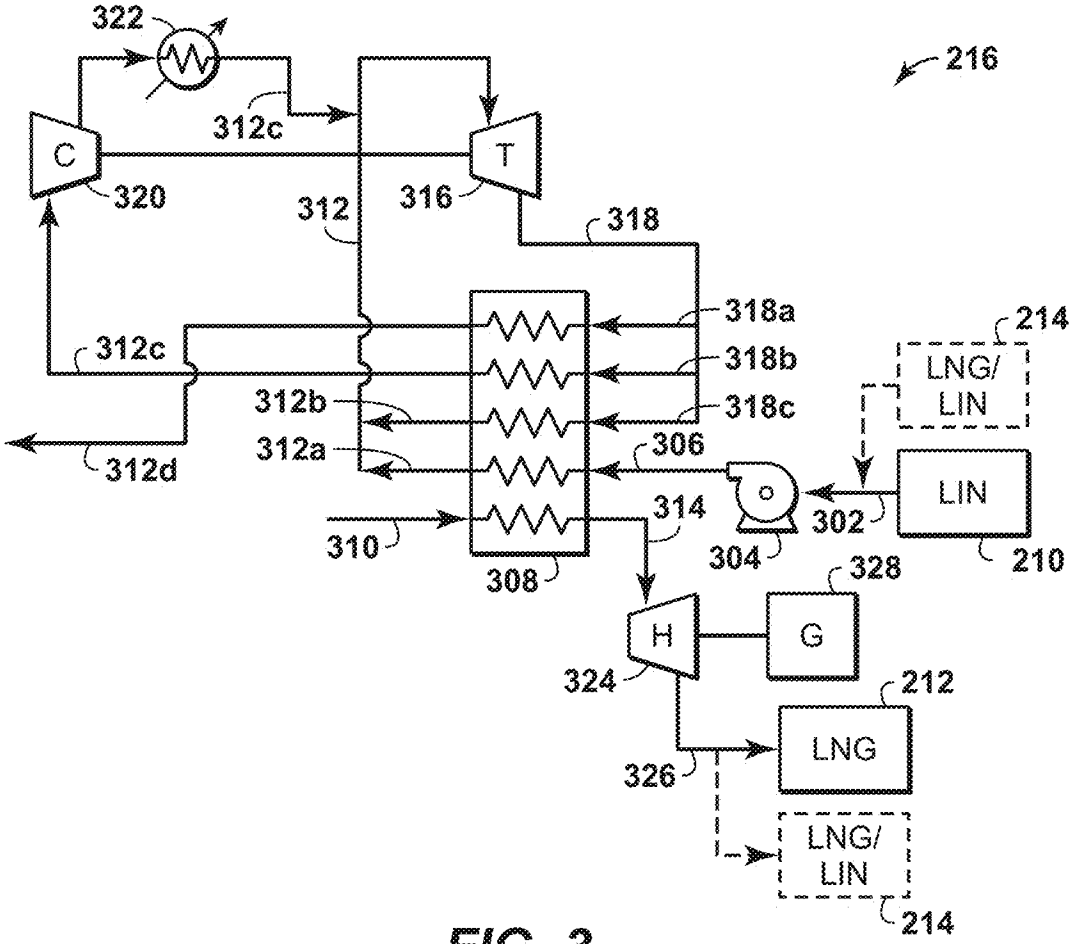
FIG. 3 is a schematic diagram of a LIN-to-LNG process module according to disclosed aspects.

FIG. 3 is a simplified schematic diagram showing the LIN-to-LNG process module 216 in further detail. A LIN stream 302 from the LIN tank 210 or one of the combination tanks 214 passes through at least one pump 304 to increase the pressure of the LIN stream 302 to produce a high pressure LIN stream 306. The high pressure LIN stream 306 passes through at least one heat exchanger 308 that exchanges heat between the high pressure LIN stream 306 and the pre-cooled treated natural gas stream 310 from an FPU (not shown) to produce a warmed nitrogen gas stream 312 and an at least partially condensed natural gas stream 314. At least one expander service 316 reduces the pressure of the warmed nitrogen gas stream 312 to produce at least one additionally cooled nitrogen gas stream 318. In an aspect, the LIN-to-LNG process module 216 may include at least three expander services that reduce the pressure of at least three warmed nitrogen gas streams 312*a*, 312*b*, 312*c* to produce at least three additionally cooled nitrogen gas streams 318*a*, 318*b*, 318*c*. The additionally cooled nitrogen gas streams 318*a*, 318*b*, 318*c* may exchange heat with the natural gas stream 310 in the at least one heat exchanger 308 to form the warmed nitrogen gas streams 312*b*, 312*c*, 312*d*. The at least one expander service 316 may be coupled with at least one generator to generate electrical power, or the at least one expander service may be directly coupled to at least one compressor 320 that compresses one of the warmed nitrogen gas streams 312*c*. In an aspect of the disclosure, the at least three expander services may be each coupled with at least one compressor that is used to compress a warmed nitrogen gas stream. The compressed warmed nitrogen gas stream 312*c* may be cooled by exchanging heat with the environment in an ancillary heat exchanger 322 prior to being expanded in the turboexpander 316 to produce the additionally cooled nitrogen gas stream 318. The additionally cooled nitrogen gas stream 318 may exchange heat with the natural gas stream 310 in the at least one heat exchanger 308 to form the warmed nitrogen gas stream 312. One of the warmed nitrogen gas streams 312*d* is vented to the atmosphere. The at least partially condensed natural gas stream 314 is further expanded, cooled, and condensed in a hydraulic turbine 324 to produce an LNG stream 326, which is then stored in the LNG tank 212 or one of the multipurpose tanks 214. A generator 328 is operatively connected to the hydraulic turbine 324 and is configured to generate power that may be used in the liquefaction process.

Figure 4A:
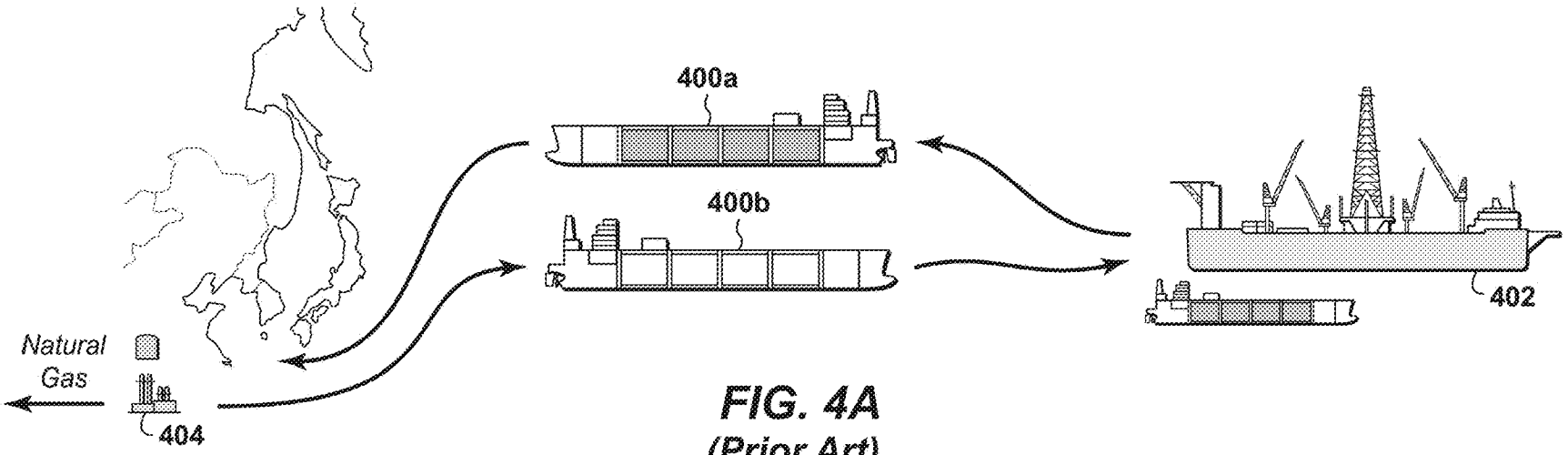
FIG. 4A (Prior Art)
FIG. 4A is a simplified diagram of the value chain of known FLNG technology.
Figure 4B:
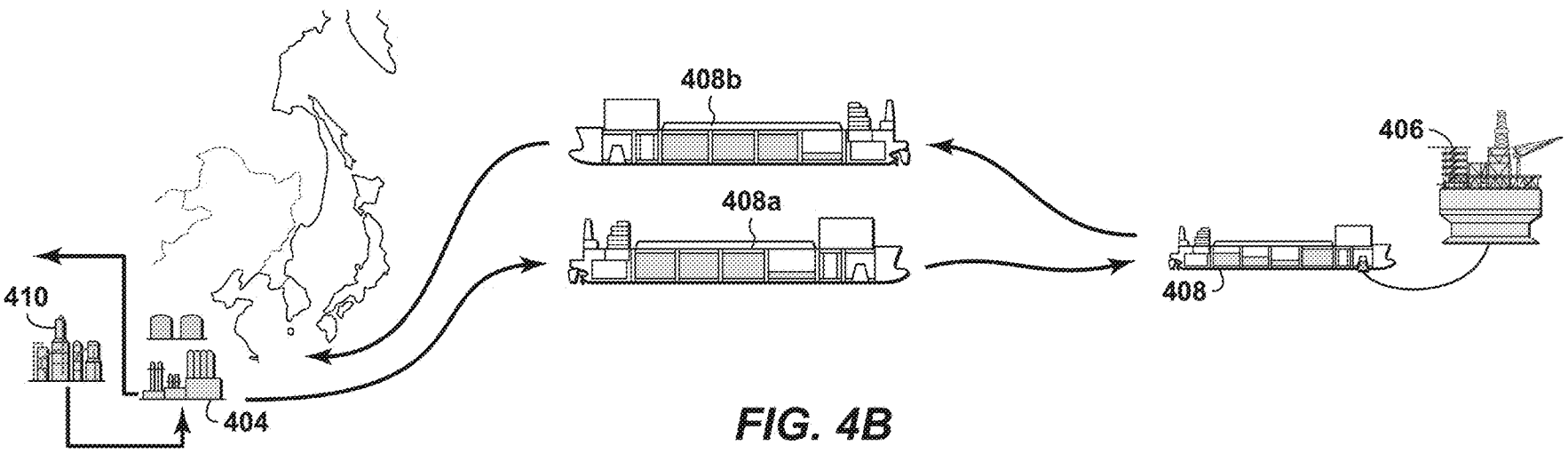
FIG. 4B is a simplified diagram of the value chain of the disclosed aspects.

FIGS. 4A and 4B are simplified diagrams highlighting a difference between the value chain of the aspects disclosed herein and the value chain of conventional FLNG technology, where an FLNG facility contains all or virtually all equipment necessary to process and liquefy natural gas. As shown in FIG. 4A, an LNG cargo ship 400*a* transports LNG from an FLNG facility 402 to a land-based import terminal 404 where the LNG is offloaded and regasified. The LNG cargo ship 400*b*, now empty of cargo and ballast, returns to the FLNG facility to be re-loaded with LNG. In contrast, the aspects disclosed herein provide an FPU 406 having a much smaller footprint than the FLNG facility 402 (FIG. 4B). The liquefaction vessel, loaded with LIN at 408*a*, arrives at the FPU 406 and, as previously described, cools and liquefies pre-cooled treated natural gas from the FPU using the stored LIN. The liquefaction vessel, now loaded with LNG at 408*b*, sails to the import terminal 404, where the LNG is offloaded and regasified. The cold energy from the regasification of the LNG is used to liquefy nitrogen at the import terminal 404. Nitrogen used at the import terminal 404 is produced at an air separation unit 410. The air separation unit 410 may be within the battery limits of the import terminal 404 or at a separate facility from the import terminal 404. The LIN is then loaded into the liquefaction vessel 408, which returns to the FPU 406 to repeat the liquefaction process.

The use of LIN in the LNG liquefaction process as disclosed herein provides additional benefits. For example, LIN may be used to liquefy LNG boil off gas from the LNG tanks and/or the multipurpose tanks during LNG production, transport and/or offloading. LIN and/or liquid nitrogen boil off gas may be used to keep the liquefaction equipment cold during turndown or shutdown of the liquefaction process. LIN may be used to liquefy vaporized nitrogen to produce an "idling-like" operation of the liquefaction process. Small helper motors may be attached to the compressor/expander combinations found in the expander services to keep the compressor/expander services spinning during turndown or shutdown of the liquefaction process. Nitrogen vapor may be used to derime the heat exchangers during the periods between LNG production on the liquefaction vessel. The nitrogen vapor may be vented to the atmosphere.

Figure 5:
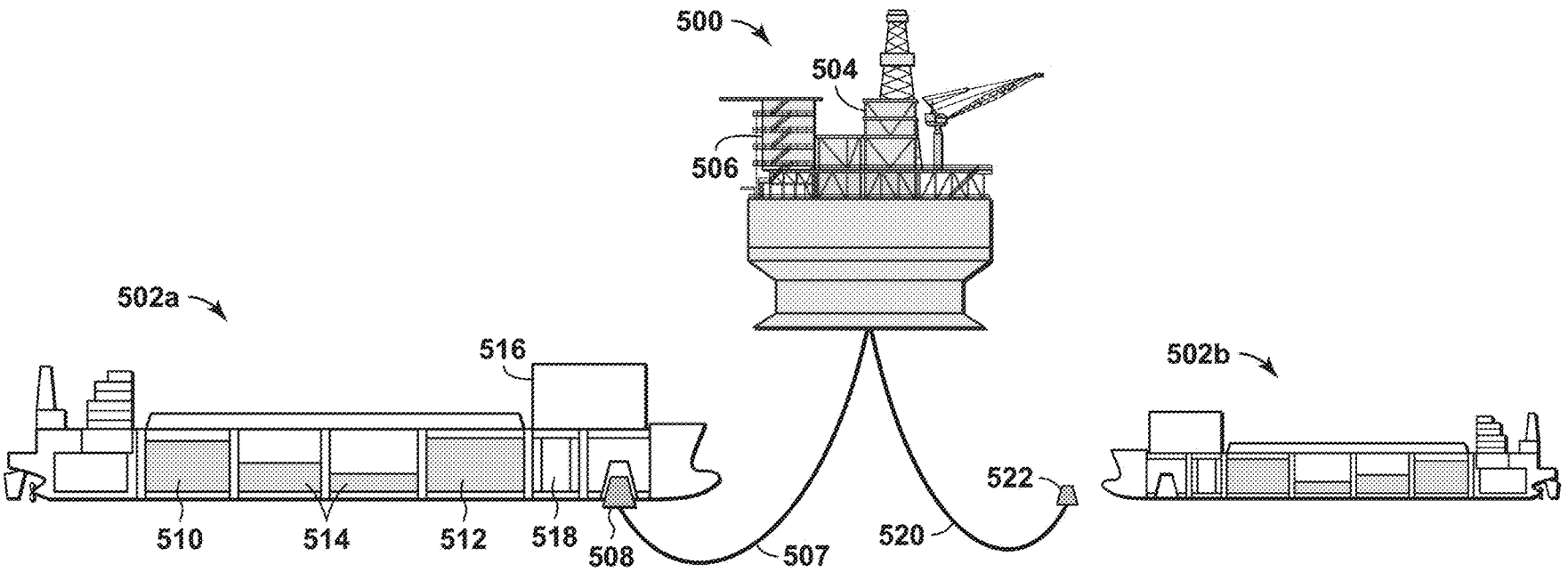
FIG. 5 is a simplified diagram of LNG production according to disclosed aspects.

FIG. 5 is an illustration of another disclosed aspect where natural gas is produced and treated using the FPU 500. Natural gas may be produced and treated on the FPU 500. The FPU 500 may contain gas processing equipment 504 to remove impurities, if present, from the natural gas, to make the produced natural gas suitable for liquefaction and/or marketing. Such impurities may include water, heavy hydrocarbons, sour gases, and the like. The FPU may also contain one or more pre-cooling means 506 to pre-cool the treated natural gas prior to being transported to the liquefaction vessel. The pre-cooling means 506 may comprise deep sea-water retrieval and cooling, mechanical refrigeration, or other known technologies. The pre-cooled treated natural gas may be transported from the FPU 500 to a first liquefaction vessel 502*a* via a first pipeline 507 and a first moored floating disconnectable turret 508 which can be connected and reconnected to one or more liquefaction vessels. The first liquefaction vessel 502*a* includes at least one LIN tank 510 that only stores liquid nitrogen and at least one LNG tank 512 that only stores LNG. The remaining tanks 514 of the first liquefaction vessel 502*a* may be designed to alternate between storage of LIN and LNG. The treated natural gas is liquefied on the liquefaction vessel using equipment in a LIN-to-LNG process module 516, which may include at least one heat exchanger that exchanges heat between a LIN stream and the natural gas stream to at least partially vaporize the LIN stream and at least partially condense the natural gas stream. The LIN-to-LNG process module 516 may comprise other equipment such as compressors, expanders, separators and/or other commonly known equipment to facilitate the liquefaction of the natural gas. The LIN-to-LNG process module 516 is suitable to produce greater than 2 MTA of LNG, or more preferably produce greater than 4 MTA of LNG, or more preferably produce greater than 6 MTA of LNG. The first liquefaction vessel 502*a* may also comprise additional utility systems 518 associated with the liquefaction process. The utility systems 518 may be located within the hull of the first liquefaction vessel 502*a* and/or on the topside thereof. A second pipeline 520 may be connected to a second moored floating disconnectable turret 522 that is made ready to receive a second liquefaction vessel 502*b*. The functional design of second liquefaction vessel 502*b*, is substantially the same as the first liquefaction vessel 502*a* (including, for example, equipment in the LIN-to-LNG process module 516) and for the sake of brevity will not be further described. The second liquefaction vessel 502*b* preferably is connected to the second moored floating disconnectable turret 522 prior to the ending of natural gas transport to the first liquefaction vessel 502*a*. In this way, natural gas from the FPU 500 can be easily transitioned to the second liquefaction vessel 502*b* without significant interruption of natural gas flow from the FPU 500.

Figure 6:
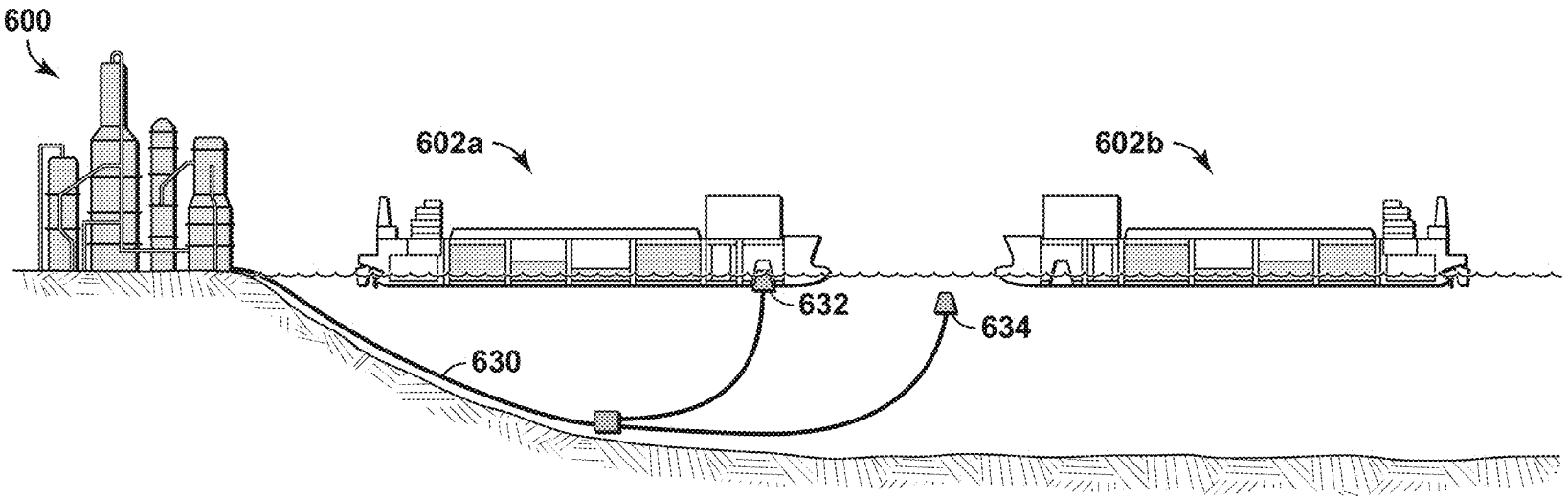
FIG. 6 is a simplified diagram of LNG production according to disclosed aspects.

FIG. 6 is an illustration of another aspect of the disclosure that can be used where natural gas processing facilities may be placed onshore. As shown in FIG. 6, natural gas processing facilities 600 located onshore may be used to remove impurities from the natural gas and/or pre-cool the natural gas as previously described. The treated natural gas may be transported offshore using a pipeline 630 connected to first and second moored floating disconnectable turrets 632, 634 which can be connected and reconnected to one or more liquefaction vessels, such as first and second liquefaction vessels 602*a*, 602*b*. For example, the first moored floating disconnectable turret 632 may connect the pipeline 630 to the first liquefaction vessel 602*a* so that the treated natural gas may be transported thereto and liquefied thereon. The second moored floating disconnectable turret 634 may connect the pipeline 630 to the second liquefaction vessel 602*b* prior to the ending of natural gas transport to the first liquefaction vessel 602*a*. In this way, natural gas from the onshore natural gas processing facilities 600 can be easily transitioned to transport to the second liquefaction vessel 602*b* without significant interruption of natural gas flow from the onshore natural gas processing facilities 600. In an aspect, the first and second liquefaction vessels 602*a*, 602*b* include the same or substantially the same process equipment thereon. Advantages of the aspects disclosed in FIG. 6 is that over-water transfer of LNG at the production site is eliminated since the LNG is produced on the liquefaction vessels. Another advantage is that because pipeline 630 delivers treated and/or pre-cooled natural gas to a point offshore, significant dredging and near-shore site preparation are not required to receive large liquefaction vessels.

Figure 7:
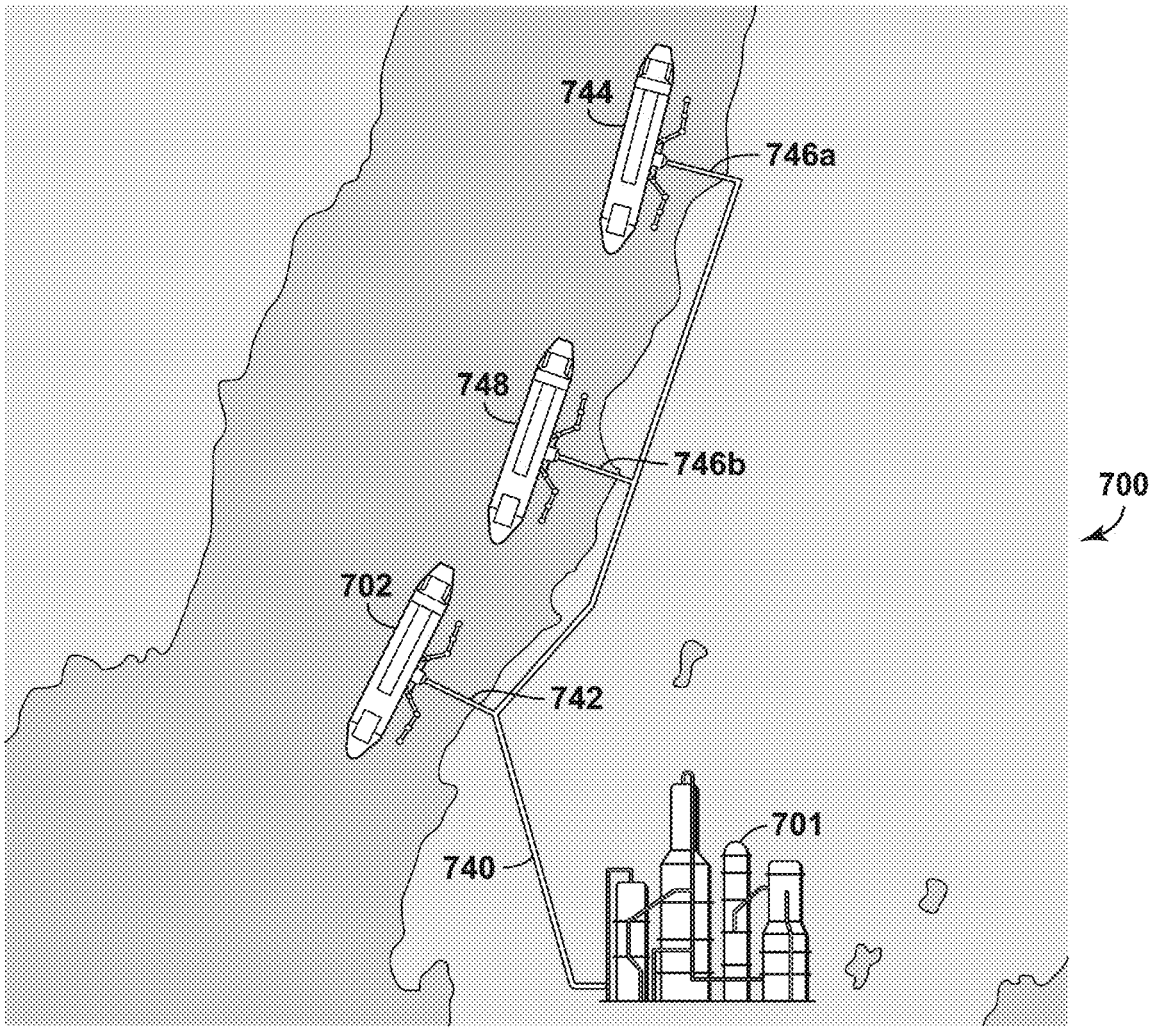
FIG. 7 is a simplified diagram of LNG production according to disclosed aspects.

FIG. 7 is an illustration of an LNG export terminal 700 according to another aspect of the disclosure in which natural gas processing facilities 701 located onshore remove impurities and/or pre-cool natural gas as previously described. The treated natural gas may be transported near-shore via a gas pipeline 740. The treated natural gas may be transported to a liquefaction vessel 702 via a first berth 742. The liquefaction vessel 702 is configured similarly to previously described liquefaction vessels herein and will not be further described. The first berth 742 may include gas loading arms that can be connected and reconnected to the liquefaction vessel 702. The treated natural gas is liquefied on the first liquefaction vessel as described in previous aspects. One or more conventional LNG carriers, LIN, or dual-purpose carriers 744 may be fluidly connected to the liquefaction vessel 702 via additional berths 746*a*, 746*b*. Each additional berth 746*a*, 746*b* includes cryogenic liquid loading arms to receive LNG from the liquefaction vessel 702 and/or transport LIN to the liquefaction vessel 702. In an aspect, a dual-purpose carrier 748 is received at one of the additional berths 746*b* to exchange cryogenic liquids with the liquefaction vessel 702. The dual-purpose carrier 748 is a ship capable of transporting LIN to an export terminal and also capable of transporting LNG to an import terminal. The dual-purpose carrier 748 may not have any LNG processing equipment installed thereon or therein. The liquefaction vessel 702 may be connected to cryogenic loading arms located on the first berth 742 to allow for cryogenic fluid transfer between the dual-purpose carrier 748 and the liquefaction vessel 702. LNG produced on the liquefaction vessel 702 is transported from the liquefaction vessel 702 to the dual-purpose carrier 748 via the first berth 742 and the additional berth 746*b*. LIN is transported from the dual-purpose carrier 748 to the liquefaction vessel 702 via the additional berth 746*b* and the first berth 742. The liquefaction vessel 702 may be temporarily or permanently docked at the first berth or at a nearby position offshore, and the dual-purpose carrier 748 may be used to transport LNG to the import terminals (not shown) and transport liquid nitrogen to the export terminal. An advantage of the aspects disclosed in FIG. 7 is that a single liquefaction vessel may be sufficient for LNG production and storage at the LNG export terminal 700. One or more than one conventional LNG carriers, liquid nitrogen carriers and/or dual-purpose carriers can be used for LNG storage and transport to import terminals. As a liquefaction vessel is expected to cost more than conventional carriers (because of the LNG liquefaction modules on the liquefaction vessel), the option to use conventional carriers to transport LNG and LIN may be preferable to the use of liquefaction vessels for transportation purposes.

Figure 8:
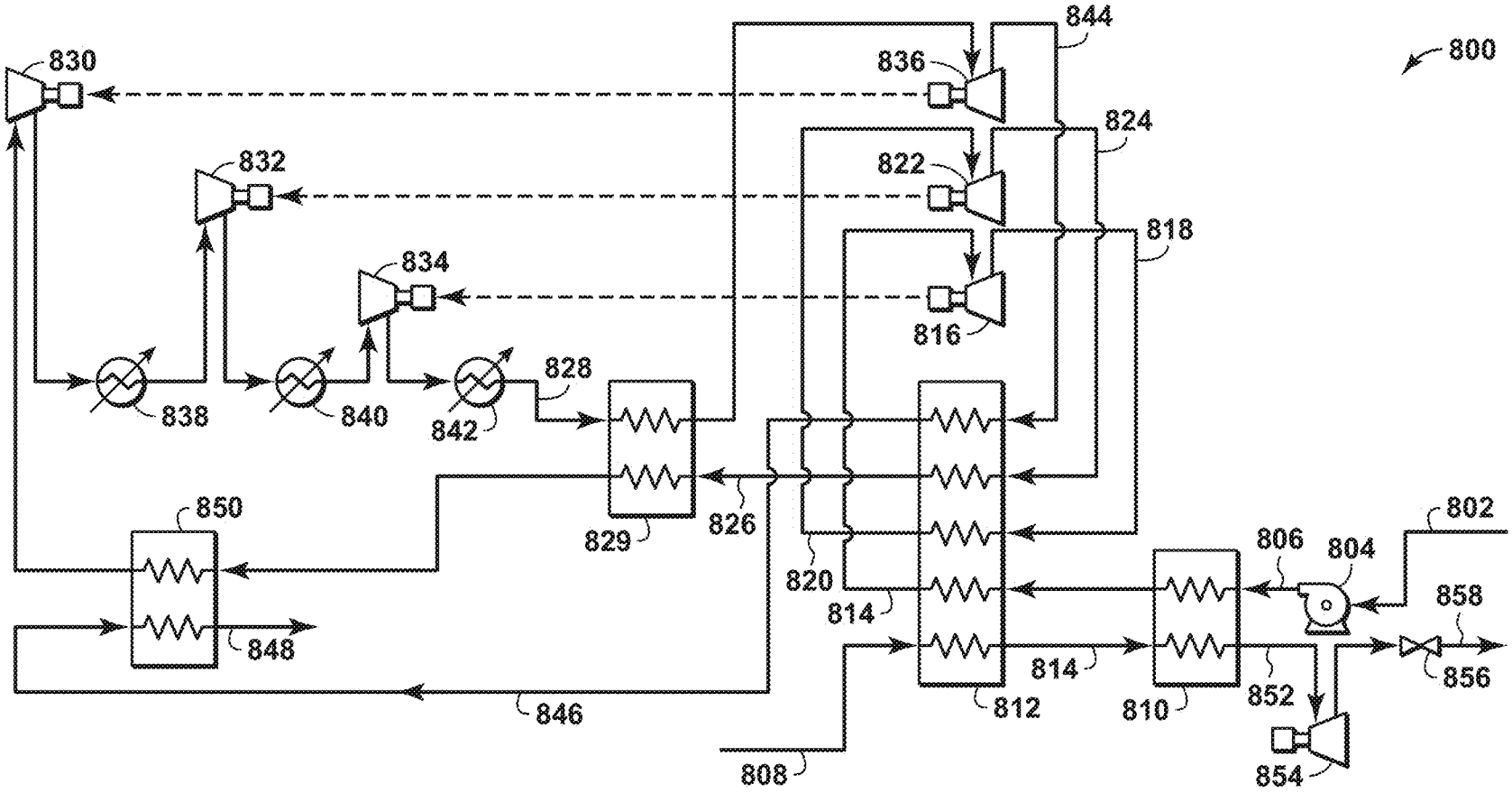
FIG. 8 is a schematic diagram of LIN-to-LNG process equipment according to disclosed aspects.

FIG. 8 is a schematic illustration of a LIN-to-LNG process module 800 according to disclosed aspects. The LIN-to-LNG process module 800 is disposed to be installed in or on a liquefaction vessel as previously disclosed. A liquid nitrogen stream 802 may be directed to a pump 804. The pump 804 may increase the pressure of the liquid nitrogen stream 802 to greater than 400 psi, to thereby form a high pressure liquid nitrogen stream 806. The high pressure liquid nitrogen stream 806 exchanges heat with a natural gas stream 808 in first and second heat exchangers 810, 812 to form a first warmed nitrogen gas stream 814. The first warmed nitrogen gas stream 814 is expanded in a first expander 816 to produce a first additionally cooled nitrogen gas stream 818. The first additionally cooled nitrogen gas stream 818 exchanges heat with the natural gas stream 808 in the second heat exchanger 812 to form a second warmed nitrogen gas stream 820. The second warmed nitrogen gas stream 820 is expanded in a second expander 822 to produce a second additionally cooled nitrogen gas stream 824. The second additionally cooled nitrogen gas stream 824 exchanges heat with the natural gas stream 808 in the second heat exchanger 812 to form a third warmed nitrogen gas stream 826. The third warmed nitrogen gas stream 826 may indirectly exchange heat with other process streams. For example, the third warmed nitrogen gas stream 826 may indirectly exchange heat with a compressed nitrogen gas stream 828 in a third heat exchanger 829 prior to the third warmed nitrogen gas stream 826 being compressed in three compression stages to form the compressed nitrogen gas stream 828. The three compression stages may comprise a first compressor stage 830, a second compressor stage 832, and a third compressor stage 834. The third compressor stage 834 may be driven solely by the shaft power produced by the first expander 816. The second compressor stage 832 may be driven solely by the shaft power produced by the second expander 822. The first compressor stage 830 may be driven solely by the shaft power produced by a third expander 836. The compressed nitrogen gas stream 828 may be cooled by indirect heat exchange with the environment after each compression stage, using first, second, and third coolers 838, 840, and 842, respectively. The first, second, and third coolers 838, 840, and 842 may be air coolers, water coolers, or a combination thereof. The compressed nitrogen gas stream 828 may be expanded in the third expander 836 to produce a third additionally cooled nitrogen gas stream 844. The third additionally cooled nitrogen gas stream 844 may exchange heat with the natural gas stream 808 in the second heat exchanger to form a fourth warmed nitrogen gas stream 846. The fourth warmed nitrogen gas stream 846 may indirectly exchange heat with other process streams prior to being vented to the atmosphere as a nitrogen gas vent stream 848. For example, the fourth warmed nitrogen gas stream 846 may indirectly exchange heat with the third warmed nitrogen gas stream 826 in a fourth heat exchanger 850. As can be seen from FIG. 8, the natural gas stream 808 may exchange heat in the first and second heat exchangers 810, 812 with the high pressure liquid nitrogen stream 806, the first additionally cooled nitrogen gas stream 818, the second additionally cooled nitrogen gas stream 824, and the third additionally cooled nitrogen gas stream 844 to form a pressurized liquid natural gas stream 852. The pressurized liquid natural gas stream 852 may be reduced in pressure, for example by using an expander 854 and/or valving 856, to form an LNG product stream 858 that may be directed to one or more storage tanks of the liquefaction vessel and/or conventional carriers operationally connected to the liquefaction vessel. In contrast to other known liquefaction processes, the liquefaction process described herein has the advantage of requiring a minimal amount of power and process equipment while still efficiently producing LNG.

Figure 9:
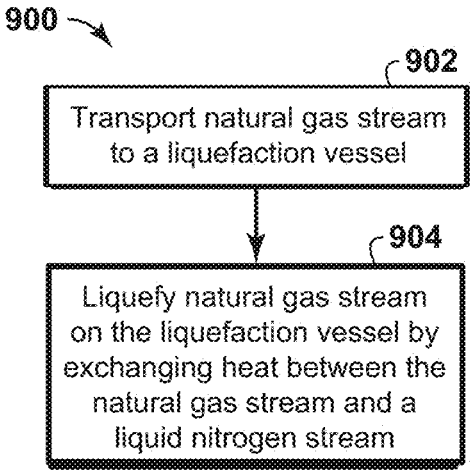
FIG. 9 is a flowchart showing a method according to disclosed aspects.

FIG. 9 is a flowchart of a method 900 of a method for producing liquefied natural gas (LNG) according to disclosed aspects. At block 902 a natural gas stream is transported to a liquefaction vessel. The liquefaction vessel includes at least one tank that only stores liquid nitrogen and at least one tank that only stores LNG. At block 904 the natural gas stream is liquefied on the liquefaction vessel using at least one heat exchanger that exchanges heat between the natural gas stream and a liquid nitrogen stream to at least partially vaporize the liquefied nitrogen stream, thereby forming a warmed nitrogen gas stream and an at least partially condensed natural gas stream comprising LNG.

The steps depicted in FIG. 9 are provided for illustrative purposes only and a particular step may not be required to perform the disclosed methodology. Moreover, FIG. 9 may not illustrate all the steps that may be performed. The claims, and only the claims, define the disclosed system and methodology.

The aspects described herein have several advantages over known technologies. For example, the power requirement for the liquefaction process disclosed herein is less than 20%, or more preferably less than 10%, or more preferably less than 5% the power requirement of a conventional liquefaction process used on a liquefaction vessel. For this reason, the power requirement for the liquefaction process disclosed herein may be much lower than the required propulsion power of the liquefaction vessel. The liquefaction vessel according to disclosed aspects may have the same propulsion system as a conventional LNG carrier since natural gas liquefaction is predominantly accomplished by the vaporizing of the stored liquid nitrogen and not by the onboard power production of the liquefaction vessel.

Another advantage is that the liquefaction process disclosed herein is capable of producing greater than 2 MTA of LNG, or more preferably producing greater than 4 MTA of LNG, or more preferably producing greater than 6 MTA of LNG on a single liquefaction vessel. In contrast to known technologies, the LNG production capacity of the disclosed liquefaction vessel is primarily determined by the storage capacity of the liquefaction vessel. A liquefaction vessel with an LNG storage capacity of 140,000 $m^3$ can support a stream day annual production of LNG of approximately 6 MTA at a liquefaction vessel arrival frequency of 4 days. The tank or tanks that only store liquid nitrogen may have a total volume of less than 84,000 $m^3$, or more preferably a volume of approximately 20,000 $m^3$, to provide a liquefaction vessel with a total storage capacity of 160,000 $m^3$.

Additionally, the liquefaction process according to disclosed aspects has the additional advantage of allowing for fast startup and reduced thermal cycling since a fraction of the stored liquid nitrogen can be used to keep the equipment of the liquefaction module cold during periods of no LNG production. Additionally, the overall cost of the disclosed liquefaction module is expected to be significantly less than the cost of a conventional liquefaction module. The LIN-to-LNG liquefaction module may be less than 50% of the capital expense (CAPEX) of an equivalent capacity conventional liquefaction module, or more preferably less than 20% the CAPEX of an equivalent capacity conventional liquefaction module. The reduced cost of the liquefaction module may make it economical to have the liquefaction vessels transport the LNG to market rather than having to transfer its cargo to less expensive ships in order to reduce the number of liquefaction vessels.

It should be understood that the numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A method for producing liquefied natural gas (LNG), comprising:

transporting liquid nitrogen in the liquefaction vessel;

transporting a natural gas stream to the liquefaction vessel;

liquefying the natural gas stream on the liquefaction vessel using at least one heat exchanger that exchanges heat between the natural gas stream and a liquid nitrogen stream from the transported liquid nitrogen, to at least partially vaporize the liquefied nitrogen stream, thereby forming a warmed nitrogen gas stream and an at least partially condensed natural gas stream comprising LNG; and storing and transporting the LNG in the liquefaction vessel in a tank exclusively reserved for LNG storage therein;

wherein the liquefaction vessel further includes at least one tank that exclusively stores and transports liquid nitrogen therein and at least one tank that stores either LNG or liquid nitrogen therein;

wherein the tank exclusively reserved for LNG storage does not store liquid nitrogen when liquid nitrogen is transported in the liquefaction vessel, and wherein the at least one tank that exclusively stores liquid nitrogen does not store LNG when LNG is transported in the liquefaction vessel.

2. The method of claim 1, further comprising:

obtaining the natural gas stream from a floating production unit (FPU) vessel that produces natural gas from a reservoir and treats the produced natural gas to remove at least one of water, heavy hydrocarbons, and sour gases therefrom prior to transporting the natural gas stream to the liquefaction vessel.

3. The method of claim 2, further comprising:

transporting the warmed nitrogen gas stream to the FPU vessel; and using the warmed nitrogen gas stream within a process on the FPU vessel.

4. The method of claim 3, further comprising:

compressing the warmed nitrogen gas stream on the FPU; and injecting the compressed warmed nitrogen gas stream into a reservoir for pressure maintenance.

5. The method of claim 1, further comprising:

reducing a pressure of the warmed nitrogen gas stream to produce at least one additionally cooled nitrogen gas stream; and exchanging heat between the at least one additionally cooled nitrogen gas stream and the natural gas stream to form at least one additional warmed nitrogen gas stream.

6. The method of claim 5, wherein the pressure of the warmed nitrogen gas stream is reduced using at least one expander service.

7. The method of claim 6, further comprising generating electrical power from at least one generator coupled to the at least one expander service.

8. The method of claim 1, further comprising:

transporting the natural gas stream to the liquefaction vessel via a moored floating disconnectable turret configured to be connected, disconnected, and reconnected to the liquefaction vessel.

9. The method of claim 8, further comprising docking the liquefaction vessel at an export terminal while the natural gas stream is being liquefied.

10. The method of claim 8, wherein a single liquefaction vessel is used for LNG production and storage at the export terminal, and further comprising:

storing LNG at an export terminal and transporting the LNG to an import terminal using more than one of LNG carriers, liquid nitrogen carriers and dual-purpose carriers.

11. The method of claim 1, further comprising:

transporting the natural gas stream to the liquefaction vessel via a loading arm connected to an onshore gas pipeline, the loading arm being configured to be connected, disconnected, and reconnected to the liquefaction vessel.

12. The method of claim 11, further comprising:

transporting liquid nitrogen from a separate vessel to the liquefaction vessel via a cryogenic liquid loading arm configured to be connected, disconnected, and reconnected to the liquefaction vessel, the liquid nitrogen stream comprising the liquid nitrogen transported in the liquefaction vessel.

13. The method of claim 11, further comprising:

transporting the LNG from the liquefaction vessel to a separate vessel via a cryogenic liquid loading arm configured to be connected, disconnected, and reconnected to the liquefaction vessel.

14. The method of claim 1, further comprising:

at an LNG import terminal, liquefying nitrogen gas using available exergy from gasification of the LNG, thereby forming the liquefied nitrogen in the liquid nitrogen stream.

15. The method of claim 1, further comprising:

cooling the natural gas stream to a temperature not less than about −40° C. prior to transporting the natural gas stream to the liquefaction vessel.

16. The method of claim 1, further comprising:

obtaining the natural gas stream from an onshore facility that treats natural gas to remove at least one of water, heavy hydrocarbons, and sour gases therefrom to produce said natural gas stream.

17. The method of claim 1, further comprising:

during liquefaction turndown and/or shutdown periods, maintaining a temperature of liquefaction equipment on the liquefaction vessel using one of liquid nitrogen and liquid nitrogen boil-off gas.

18. The method of claim 1, further comprising liquefying vaporized nitrogen gas using the liquid nitrogen.

19. The method of claim 1, further comprising the use of warm nitrogen gas to derime the at least one heat exchanger during periods between LNG production on the liquefaction vessel.

20. A system for liquefying a natural gas stream, comprising:

a liquefaction vessel that transports liquefied natural gas from a first location to a second location and transports liquefied nitrogen (LIN) to the first location, the liquefaction vessel including;

at least one tank that exclusively stores LIN, at least one tank exclusively reserved for storing LNG therein, at least one tank that stores either LIN or LNG therein, and an LNG liquefaction system including at least one heat exchanger that exchanges heat between a LIN stream from LIN stored on the natural gas liquefaction vessel and the natural gas stream, which is transported to the natural gas liquefaction vessel, to at least partially vaporize the LIN stream, thereby forming a warmed nitrogen gas stream and an at least partially condensed natural gas stream comprising LNG, the LNG configured to be stored on the natural gas liquefaction vessel in the at least one tank exclusively reserved for storing LNG therein, to be transported to the second location;

wherein the at least one tank exclusively reserved for storing LNG does not store LIN when LIN is transported in the liquefaction vessel to the first location, and wherein the at least one tank that exclusively stores LIN does not store LNG when LNG is transported in the liquefaction vessel to the second location.

21. The system of claim 20, further comprising:

a floating production unit (FPU) vessel configured to produce the natural gas stream from a reservoir and to remove at least one of water, heavy hydrocarbons, and sour gases from the natural gas stream prior to transporting the natural gas stream to the liquefaction vessel.

22. The system of claim 20, wherein a pressure of the warmed nitrogen gas stream is reduced to produce at least one additionally cooled nitrogen gas stream, and further comprising a second heat exchanger configured to exchange heat between the at least one additionally cooled nitrogen gas stream and the natural gas stream to thereby form additional warmed nitrogen gas streams.

23. The system of claim 22, further comprising at least one expander service configured to reduce a pressure of the warmed nitrogen gas stream.

24. The system of claim 23, further comprising at least one generator coupled to the at least one expander service, the at least one generator configured to generate electrical power.

25. The system of claim 24, further comprising motor driven compressors powered by the at least one generator, the motor driven compressors configured to compress the warmed nitrogen gas stream.

26. The system of claim 23, wherein the at least one expander service is coupled to at least one compressor to thereby compress the warmed nitrogen gas stream.

27. The system of claim 20, further comprising a moored floating disconnectable turret configured to be connected, disconnected, and reconnected to the liquefaction vessel, wherein the natural gas stream is transported to the liquefaction vessel via the moored floating disconnectable turret.

28. The system of claim 27, wherein a single liquefaction vessel is used for LNG production and storage at the export terminal, and further comprising:

storing LNG at an export terminal and transporting the LNG to an import terminal using more than one of LNG carriers, liquid nitrogen carriers and dual-purpose carriers.

29. The system of claim 20, further comprising a cryogenic liquid loading arm for transporting LIN from a separate vessel to the liquefaction vessel, the cryogenic liquid loading arm configured to be connected, disconnected, and reconnected to the liquefaction vessel.

* * * * *